US005826284A

United States Patent [19]

Wren

[11] Patent Number: 5,826,284

[45] Date of Patent: Oct. 27, 1998

[54] SHOWER CURTAIN WITH SKIRT

[76] Inventor: Boyd Wren, 2262 Uranus Ave., Las Cruces, N. Mex. 88012

[21] Appl. No.: 877,933

[22] Filed: Jun. 18, 1997

Related U.S. Application Data

[63] Continuation-in-part of Ser. No. 727,909, Oct. 9, 1996, abandoned.

[51] Int. Cl.[6] ..... A47K 3/22

[52] U.S. Cl. ..... 4/609; 4/607; 4/608

[58] Field of Search ..... 4/609, 605, 607, 4/608, 610, 558, 557; 160/330, 349.2, DIG. 6

[56] References Cited

U.S. PATENT DOCUMENTS 2,120,155 6/1938 Shera ..... 4/608
2,776,439 1/1957 Rondinelli ..... 4/558

*Primary Examiner*—David J. Walczak
*Attorney, Agent, or Firm*—Young & Basile, P.C.

[57] ABSTRACT

A shower curtain for use with a bathtub comprises a main curtain suspendable from a curtain rod and a skirt attached to the main curtain along a horizontal seam at a level at least approximately five inches above the top of the front wall of the bathtub. The main curtain drapes downwardly to the outside of the tub so that the seam is located directly above the outer surface of tub front wall. The skirt drapes straight downwardly from the seam so that it is positioned outside of the tub, while the main curtain below the seam extends toward the inside of the tub, passing over the top of the tub front wall and then down into the tub. The weight of the skirt pulls downwardly on the main curtain along the seam, thereby tending to maintain the curtain generally co-planar with the skirt, draping to the outside of the bathtub. The invention shower curtain provide a shower enclosure with more usable width than has been available with prior shower curtains, and positions the skirt on the outside of the tub to present an aesthetically pleasing appearance without requiring the added expense of a separate, full length curtain liner.

9 Claims, 2 Drawing Sheets

SHOWER CURTAIN WITH SKIRT

This application is a Continuation-In-Part of U.S. patent application Ser. No. 08/727,909, filed Oct. 9, 1996, and now abandoned.

BACKGROUND OF THE INVENTION

The present invention relates to shower curtains such as are used with bathtubs to create a shower enclosure. Such shower curtains are typically suspended from a horizontally disposed curtain rod located above the level of a shower head and approximately directly above a front wall of the tub. When in use, the shower curtain must hang downward from the curtain rod so as to drape toward the interior of the tub and place the lower edge of the curtain inside the front tub wall. This ensures that water spraying from the shower head will stay within the confines of the tub and not drip down along the outside of the front tub wall. With the curtain draped to the inside of the tub, however, the front wall of the tub is exposed to the view of persons outside the tub, a situation that many consider to be not aesthetically pleasing.

As an alternative to a single shower curtain, a shower curtain and curtain liner combination may be used, with the shower curtain hanging down to the outside of the front tub wall to present a pleasing appearance, and the curtain liner draping to the interior of the tub to prevent the escape of water.

In either of these configurations, the fact that the curtain or liner drapes to the interior of the tub results in the usable space within the shower enclosure being less than would be the case if the curtain or liner were to drape to the outside of the tub. The width of the shower enclosure, as measured perpendicular to the front tub wall, is decreased by approximately six to nine inches by the interior drape of the curtain, and this reduction in width leads to less hip and shoulder room in the enclosure and a greater likelihood that the body of a showering person will unintentionally contact the interior of the shower curtain or liner. It is desirable to minimize the amount of body contact with the curtain or liner since it can result in soap from the body being deposited on the curtain or liner, requiring that the curtain or liner be washed off to avoid a buildup of soap scum with continued use. A narrower shower enclosure also has the more subjective drawback of making the showering person feel cramped for space.

Several attempts have been made to provide a shower curtain which solves the above-described problems. U.S. Pat. No. 2,120,155 teaches a shower curtain having a short apron or skirt attached thereto along a seam located just above the top of the tub front wall. The skirt extends downwardly from the seam and large metal weights are attached to the lower edge of the skirt. The lower portion of the shower curtain is placed inside the tub and the skirt is placed outside the tub, the weighted skirt pulling downwardly on the shower curtain at the seam and so drawing the portion of the curtain above the seam toward the outer surface of the tub front wall. The portion of the curtain below the seam extends toward the interior of the tub, passing over and lying against the top of the tub front wall before extending downwardly to drape to the inside of the tub.

Because the seam connecting the skirt to the shower curtain is located only a short distance above the top of the bathtub front wall, the portion of the curtain immediately below the seam lies against the top surface of the front wall. Accordingly, there is a substantial amount of contact between the curtain and the top and inside edge of the tub front wall, and it has been found that this contact results in substantial drag which resists sliding movement of the shower curtain when it is drawn between open and closed positions. This drag makes it difficult to draw the curtain without the curtain becoming misarranged, and may cause the lower portion of the shower curtain to be pulled completely out of its proper position inside of the tub.

SUMMARY OF THE INVENTION

This invention is directed toward a shower curtain usable with conventionally known bathtubs and curtain rods to provide a shower enclosure of greater usable width than the enclosure formed by a standard shower curtain or curtain/liner combination, and which may be easily drawn between open and closed positions without the curtain becoming misarranged.

According to the invention, the shower curtain comprises a main curtain suspendable from a curtain rod in the conventional manner and a skirt attached to the main curtain along a substantially horizontal seam located the proper distance below the upper edge of the main curtain to position the seam approximately six to fourteen inches above the top of the bathtub front wall when the curtain is hung from the rod.

The skirt is preferably attached to the outward facing side of the main curtain so that the skirt may drape to the outside the tub and the main curtain to the inside of the tub. The skirt weighs more than the portion of the main curtain below the seam, the greater weight of the skirt causing the main curtain above the seam to drape downwardly toward to the outside of the bathtub and so increase the usable width of the shower enclosure over that available if the curtain were to drape to the inside of the tub. The skirt extends substantially vertically downward from the seam to lie adjacent the outer surface of the wall. The main curtain below the seam extends at an angle downwardly and toward the inside of the tub, and the relatively large vertical distance between the seam and the top of the front wall minimizes the amount of contact between the curtain and the top of the tub front wall. Because the lower portion of the curtain does not rest on and drag along the top of the wall, the curtain may be drawn between open and closed positions without the lower end thereof becoming misarranged and/or being pulled out of the tub.

The main curtain thus provides a smooth, curving interior surface to direct water running down the interior of the shower curtain into the tub, while the skirt drapes to the outside of the tub and thereby provide a shower enclosure with more usable width than has been available with prior shower curtains. This arrangement also positions the skirt on the outside of the tub to present an aesthetically pleasing appearance without requiring the added expense of a separate, full length curtain liner.

If necessary, small weights may be disposed on or sewn into the skirt adjacent its lower edge to ensure that the skirt is heavy enough to draw the main curtain to the outside of the tub. Alternatively, the skirt may be made from a material weighing more than the material from which the main curtain is made.

Because the seam is spaced well above the top of the bathtub front wall, the main curtain does not drag therealong when the curtain is moved between open and closed positions. This makes the curtain easier to use and substantially eliminates the possibility of the main curtain being inadvertently pulled out of the tub during sliding movement of the curtain.

According to another feature of the invention, curtain ring spacers tubes are provided which slide over the curtain rod between pairs of adjacent curtain rings at one or both lateral ends of the shower curtain. The ring spacers hold the curtain rings apart and are of sufficient length to maintain the main curtain nearly taught so that the curtain does not "bunch up" near the end. Because the lateral ends of the curtain are held taught, it is easier for a person to grasp the curtain at a point along the lateral edge of the curtain and draw it between the open and closed positions.

DESCRIPTION OF THE PREFERRED EMBODIMENT

Figure 1:
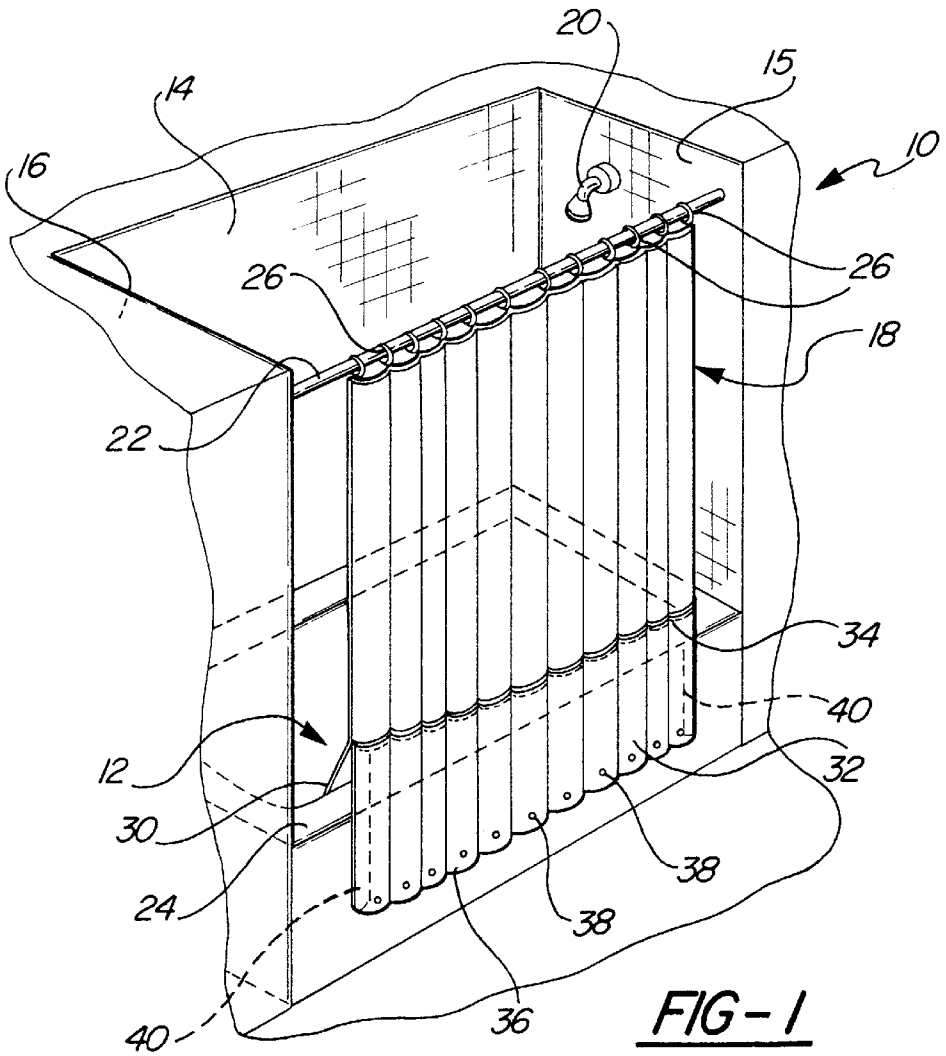
FIG. 1 is a perspective view of a shower enclosure utilizing the invention shower curtain.

As seen in FIG. 1, a shower enclosure 10 is formed by a bathtub 12, a rear wall 14, two end walls 15,16, and a shower curtain 18. A shower head 20 projects from end wall 15, and a curtain rod 22 extends substantially horizontally between end walls 15,16 at a position approximately directly above and parallel with a front wall 24 of bathtub 12.

Shower curtain 18 is suspended from curtain rod 22 in a conventional manner, for example by means of rings 26 attached to the top edge of the curtain at intervals and which slide freely along the curtain rod. Curtain 18 comprises a main curtain 30 of sufficient length to extend from curtain rod 22 to below the top of tub front wall 24, and a skirt 32 attached to the outer side (the side facing the exterior of the tub) of the main curtain along a horizontal seam 34.

Main curtain 30 and skirt 32 are preferably made from a waterproof or water resistant material such as vinyl or a woven fabric treated with a water repellant compound. The two components are attached to one another by an appropriate conventionally known method; i.e., vulcanization for vinyl materials or sewing for textiles. If a sewn seam is used, the seam is preferably sealed to maintain the waterproof/resistant quality of the fabric.

Figure 2:
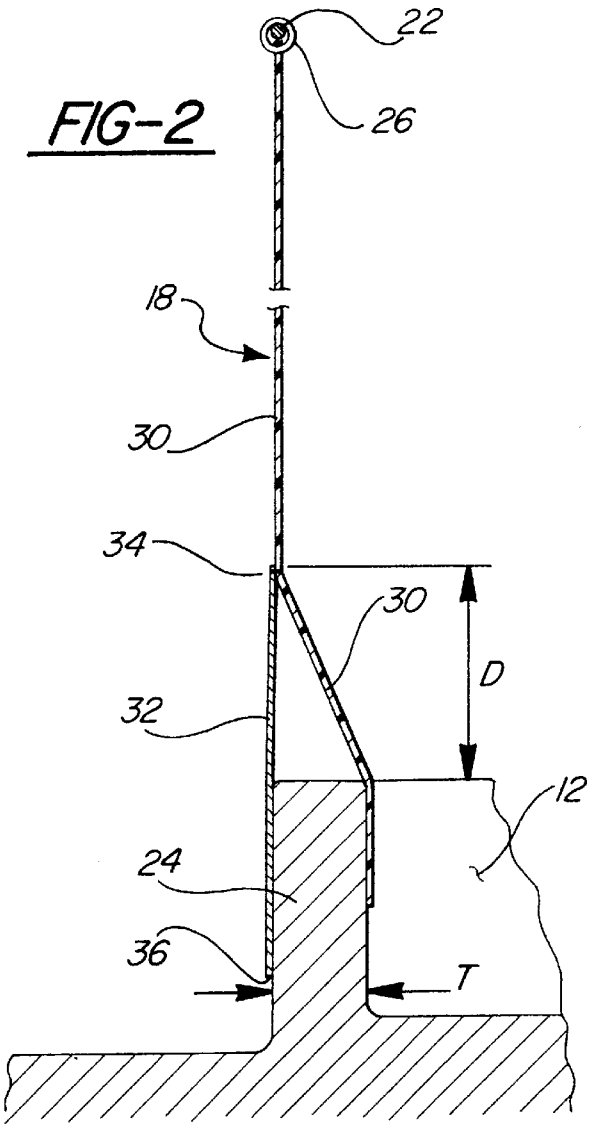
FIG. 2 is a cross-sectional view of the lower portion of the shower enclosure of FIG. 1.

As is best seen in FIG. 2, when the shower curtain 18 is suspended from curtain rod 22, the portion of main curtain 30 extending from the rod downwardly to just above seam 34 hangs substantially straight downward toward the outside of the tub so that seam 34 is located substantially directly above the outer surface of tub front wall 24. Below seam 34, main curtain 30 extends at an acute angle downwardly and toward the inside of the tub, passing over the top of tub front wall 24 and then down into tub 12. Skirt 32 drapes straight downwardly from seam 34 so that its lower edge or hem 36 is positioned outside of bathtub 12. The weight of the skirt pulls downwardly on main curtain 30 along seam 34, thereby tending to maintain the curtain generally co-planar with the skirt, as shown in FIG. 2.

Seam 34 is located the appropriate distance from the top edge of main curtain 30 to position the seam approximately six to fourteen inches above the top of tub front wall 24 when shower curtain 18 is suspended from curtain rod 22. For best effect, the vertical spacing D (see FIG. 2) between seam 34 and the top of front wall 24 should be at least twice the thickness T of the front wall. This allows the portion of main curtain 30 below seam 34 to extend downwardly and toward the interior of the bathtub, diverging from the skirt at a shallow angle and not making any substantial contact with the top surface of tub front wall 24.

In a standard bath tub shower enclosure, as installed in many hotel rooms in this country, curtain rod 22 is positioned 78 inches above the floor outside of the tub, and front wall 24 extends to a height of 15 inches above the floor. To fit such a standard sized enclosure, main curtain 30 is approximately at least 72 inches long so as to extend at least several inches below the top of tub front wall 24, seam 34 is located approximately 55 inches or less below the top edge of the curtain, and skirt 32 extends approximately 16 inches or more below the seam.

Bath tubs exist in a variety of styles and sizes having front walls of different thicknesses, and it is this dimension that determines the required height of the seam above the top of the tub front wall in order to achieve the benefits of a shower curtain according to the present invention. It is believed desirable to produce shower curtains according to the present invention in two standard configurations, one of which will adequately fit most bath tubs: 1) for use with tubs having a front wall on the order of three inches or less in thickness, a "short skirt" model wherein the skirt is approximately 18 to 21 inches long and the seam is located approximately 8 inches above the tub front wall, and 2) for use with tubs having a front wall on the order of greater than three inches in thickness, a "long skirt" model wherein the skirt is approximately 24 to 27 inches long and the seam is located approximately 14 inches above the tub front wall.

To help ensure that the upper portion of main curtain 30 and skirt 32 maintain a substantially co-planar shape and do not bow to the inside of bathtub 12, skirt 32 may have a stiffening strip 40 running vertically along the bottommost portion of either extreme lateral edge. Stiffening strips 40 may be formed of a plastic material such as high density polyethylene (HDPE) and may be sewn into or otherwise attached to skirt 32.

Small metallic weights 38 may be sewn into or otherwise attached to skirt 32 along its lower hem 36 to ensure that the skirt is heavy enough to keep the upper portion of main curtain 30 draping properly to the outside of bathtub 12.

Alternatively, skirt 32 may be made from a fabric or other flexible sheet material which is different from and heavier than the material from which main curtain 30 is made. This eliminates the need to have separately formed weights attached to the skirt and so simplifies the manufacture of the curtain. The desired weight differential between skirt 32 and the portion of main curtain 30 below seam 34 may also be achieved or added to by making the skirt longer than the lower portion of the curtain.

Figure 3:
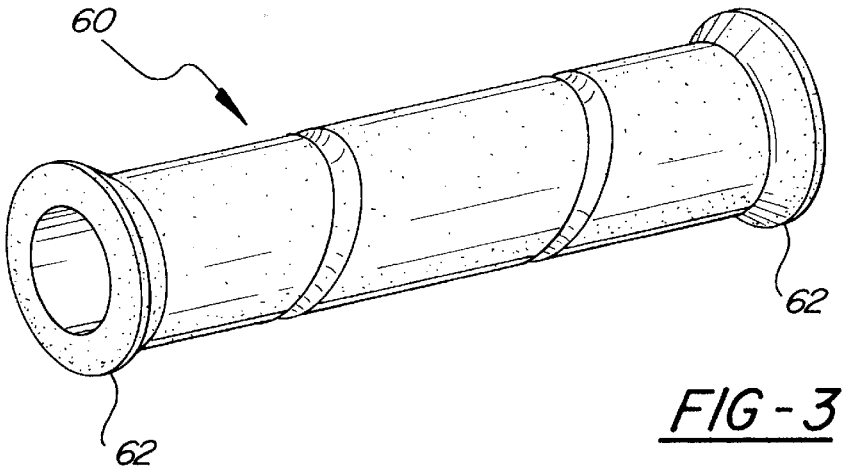
FIG. 3 is a perspective view of a curtain ring spacer tube according to the present invention.
Figure 4:
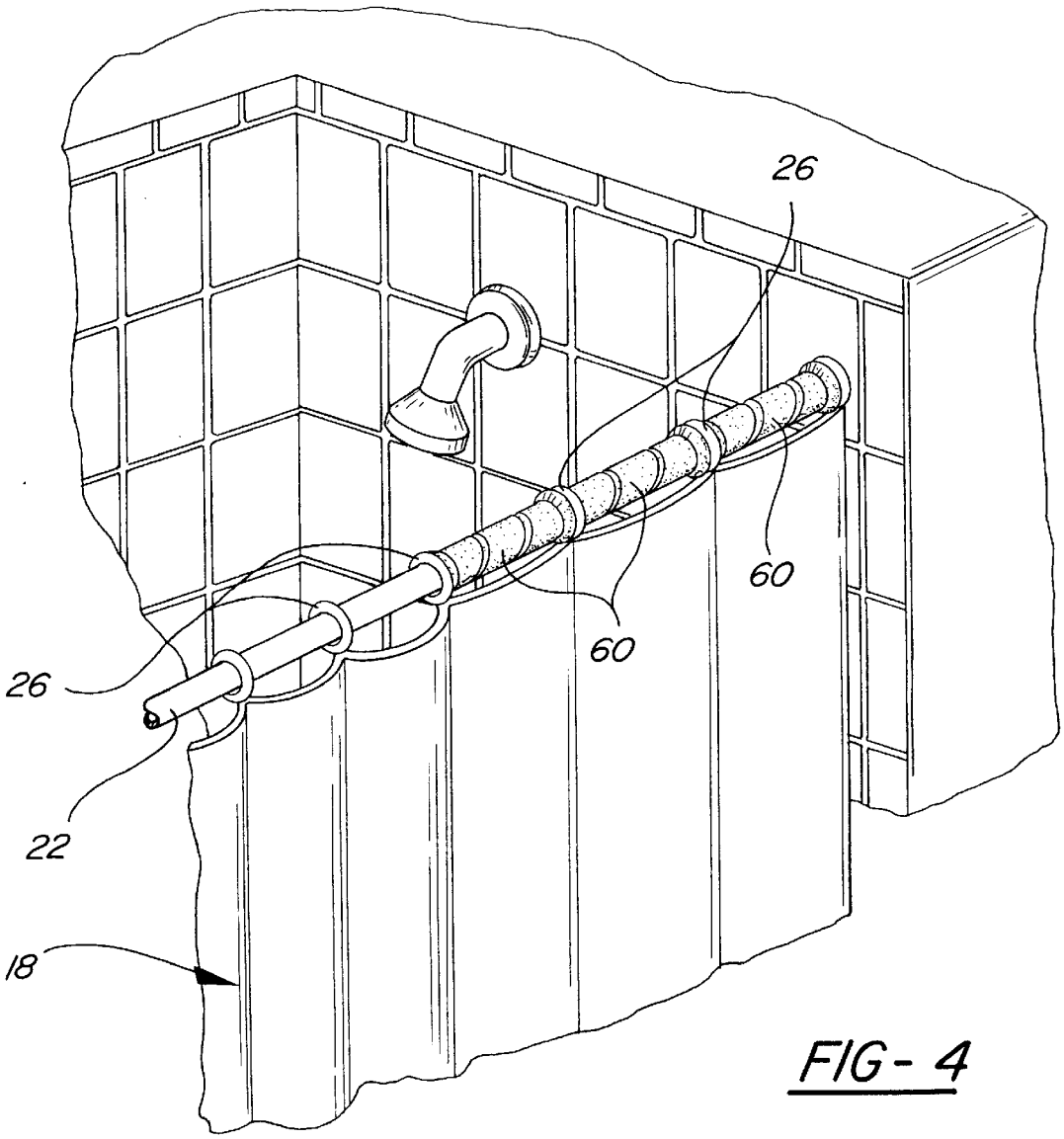
FIG. 4 is a perspective view of a portion of the shower enclosure of FIG. 1 showing spacer tubes installed at one end of the shower curtain.

FIGS. 3 and 4 depict a spacer tube 60 for use in the present invention. Spacer tube 60 is preferably formed from a plastic material and has an overall length slightly less than the spacing between curtain rings 26 when main curtain 30 is spread substantially fully out on curtain rod 22. For a standard shower curtain with six inch spacing between curtain rings 26, spacer tube 60 is approximately 5½ inches long. Spacer tube 60 is of sufficient inside diameter to fit over and slide freely along curtain rod 22, and has flared ends 62 of large enough diameter to prevent the tube from sliding inside of curtain rings 26.

As seen in FIG. 4, a plurality of spacer tubes 60 are positioned between curtain rings 26 adjacent the end of shower curtain 18 at which entry into and exit from the shower enclosure 10 is desired. Spacer tubes 60 maintain the curtain in a relatively taut condition and prevent it from gathering or "bunching" at that end when the curtain is drawn between open and closed positions. This effect of the spacer tubes complements the positioning of seam 34 well above the top of tub front wall 24, decreasing the amount of contact between the portion of main curtain 30 below the seam and the top surface of the tub front wall and so tending to eliminate binding therebetween when the curtain is drawn open or closed. Spacer tubes 60 may be located at only one end or at both ends of shower curtain 18.

Whereas a preferred embodiment of the invention has been illustrated and described in detail, it will be apparent that various changes may be made in the disclosed embodiment without departing from the scope or spirit of the invention.

The invention claimed is:

1. A shower curtain for use with a bathtub having a front wall with opposite inner and outer surfaces and a curtain rod disposed above and substantially parallel with a top of the front wall, the shower curtain comprising a main curtain suspendable from the curtain rod to place a lower end of the main curtain below the top of the front wall and a skirt attached to the main curtain along a seam spaced from the lower end of the main curtain such that when the main curtain is suspended from the curtain rod and the lower end of the main curtain is adjacent one of the surfaces of the front wall the seam is above the top surface of the front wall and the skirt may drape downwardly from the seam to be adjacent the opposite surface of the front wall, the shower curtain characterized in that:

the main curtain is made of a first flexible sheet material and the skirt is made of a second flexible sheet material of greater weight per unit volume than the first sheet material to create a weight differential between the skirt and a portion of the main curtain below the seam, the weight differential being great enough to cause the main curtain to drape toward the opposite surface of the front wall.

2. A shower curtain according to claim 1 wherein the skirt is attached to an outer side of the main curtain, whereby when the lower end of the main curtain drapes to be adjacent the inner surface of the front wall the skirt drapes to be adjacent the outer surface of the front wall.

3. A shower curtain according to claim 2 wherein the skirt has lateral edges which assume a generally vertical orientation when the main curtain is suspended from the curtain rod, and the skirt has at least one stiffening strip disposed adjacent and parallel with at least one of the lateral edges.

4. A shower curtain according to claim 2 wherein the skirt is of sufficient weight to draw the main curtain to a position wherein the seam is substantially directly above the outer surface of the front wall.

5. A shower/bath enclosure comprising:

a bathtub having a front wall with a top, a first surface and an opposite second surface;

a curtain rod disposed above and substantially parallel with the top of the front wall;

a plurality of curtain rings encircling the curtain rod to slide along the length thereof;

a shower curtain having an upper end engaging the curtain rings such that the shower curtain is suspended from the curtain rod; and at least one curtain ring spacer for encircling and sliding over the curtain rod between adjacent curtain rings at at least one lateral end of the shower curtain, the ring spacer holding the adjacent curtain rings apart and being of sufficient length to maintain the shower curtain nearly taut.

6. The shower curtain according to claim 1 wherein the skirt is sufficiently longer than the portion of the main curtain below the seam to add to the weight differential between the skirt and the portion of the main curtain below the seam, thereby contributing to the main curtain draping toward the second surface of the front wall.

7. A shower curtain for use with a bathtub having a front wall with opposite inner and outer surfaces and a curtain rod disposed above and substantially parallel with a top of the front wall, the shower curtain comprising a main curtain suspendable from the curtain rod to place a lower end of the main curtain below the top of the front wall and a skirt attached to the main curtain along a seam spaced from the lower end of the main curtain such that when the main curtain is suspended from the curtain rod and the lower end of the main curtain is adjacent one of the surfaces of the front wall the seam is above the top surface of the front wall and the skirt may drape downwardly from the seam to be adjacent the opposite surface of the front wall, the shower curtain characterized in that:

the skirt is sufficiently longer than a portion of the main curtain below the seam to create a weight differential between the skirt and the portion of the main curtain tending to cause the main curtain to drape toward the opposite surface of the front wall.

8. The shower curtain according to claim 7 wherein the portion of the main curtain below the seam is made of a first flexible sheet material and the skirt is made of a second flexible sheet material of greater weight per unit volume than the first sheet material to add to the weight differential between the skirt and the portion of the main curtain below the seam, thereby contributing to the main curtain draping toward the second surface of the front wall.

9. The shower curtain according to claim 7 wherein the skirt is attached to an outer side of the main curtain, whereby when the lower end of the main curtain drapes to be adjacent the inner surface of the front wall the skirt drapes to be adjacent the outer surface of the front wall.

* * * * *